US008958730B2

(12) United States Patent
Miura

(10) Patent No.: US 8,958,730 B2
(45) Date of Patent: Feb. 17, 2015

(54) IMAGE FORMING APPARATUS

(71) Applicant: Canon Kabushiki Kaisha, Tokyo (JP)

(72) Inventor: Yukihiro Miura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/970,831

(22) Filed: Aug. 20, 2013

(65) Prior Publication Data

US 2014/0064798 A1 Mar. 6, 2014

(30) Foreign Application Priority Data

Sep. 6, 2012 (JP) ..... 2012-196640

(51) Int. Cl.
*G03G 15/01* (2006.01)
*G03G 15/00* (2006.01)
*G03G 21/20* (2006.01)

(52) U.S. Cl.
CPC ..... *G03G 15/011* (2013.01); *G03G 15/55* (2013.01); *G03G 15/0189* (2013.01); *G03G 21/20* (2013.01); *G03G 2215/0158* (2013.01)
USPC ..... 399/301; 399/44

(58) Field of Classification Search
USPC ..... 399/301, 44, 51
See application file for complete search history.

(56) References Cited

U.S. PATENT DOCUMENTS

| | | | | |
|---|---|---|---|---|
| 5,828,925 | A * | 10/1998 | Yoshizawa | 399/39 |
| 8,270,857 | B2 | 9/2012 | Saitou et al. | |
| 8,406,644 | B2 * | 3/2013 | Motoi et al. | 399/51 |
| 2007/0110461 | A1 * | 5/2007 | Yoshida | 399/44 |
| 2010/0239279 | A1 * | 9/2010 | Saitou et al. | 399/44 |
| 2014/0064800 | A1 * | 3/2014 | Sato et al. | 399/301 |

FOREIGN PATENT DOCUMENTS

JP 2010-217544 A 9/2010

* cited by examiner

*Primary Examiner* — Walter L Lindsay, Jr.
*Assistant Examiner* — Rodney Bonnette
(74) *Attorney, Agent, or Firm* — Fitzpatrick, Cella, Harper & Scinto

(57) ABSTRACT

To accomplish this, an image forming apparatus of the present invention determines whether the temperature of an exposure unit is changing at a predetermined gradient or more, detects misregistration by forming patches and executes first registration adjustment amount calculation processing for detecting a registration adjustment amount, in a case where the temperature is not changing at the predetermined gradient or more, and executes second registration adjustment amount calculation processing for predicting the misregistration amount according to the temperature of the exposure unit measured by a first sensor, in a case where the temperature is changing at the predetermined gradient or more.

9 Claims, 13 Drawing Sheets

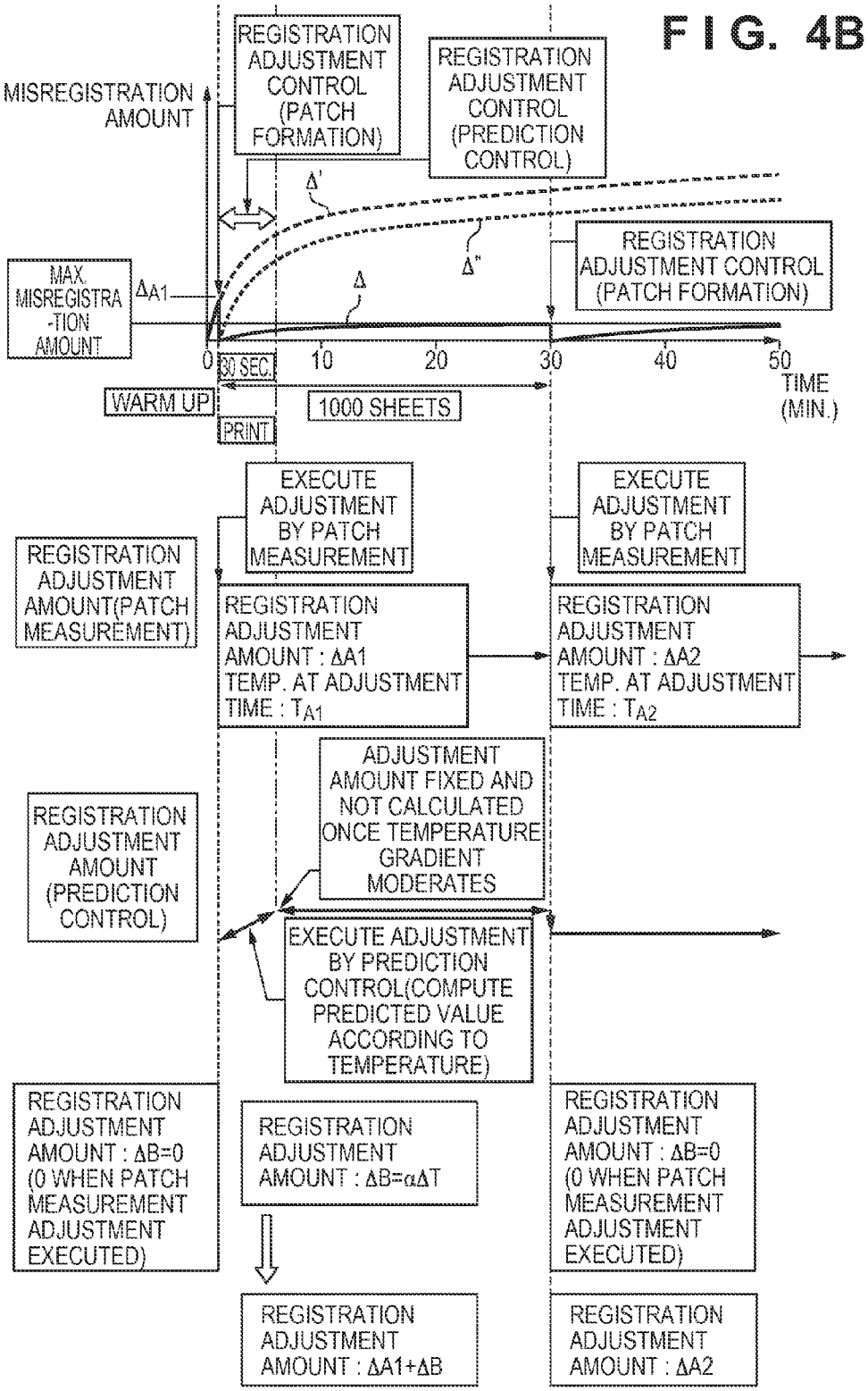
FIG. 4B
MISREGISTRATION AMOUNT
REGISTRATION ADJUSTMENT CONTROL (PATCH FORMATION)
REGISTRATION ADJUSTMENT CONTROL (PREDICTION CONTROL)
Δ'
Δ"
Δ
REGISTRATION ADJUSTMENT CONTROL (PATCH FORMATION)
MAX. MISREGISTRA-TION AMOUNT
ΔA1
0
30 SEC.
10
20
30
40
50
TIME (MIN.)
WARM UP
1000 SHEETS
PRINT
EXECUTE ADJUSTMENT BY PATCH MEASUREMENT
EXECUTE ADJUSTMENT BY PATCH MEASUREMENT
REGISTRATION ADJUSTMENT AMOUNT(PATCH MEASUREMENT)
REGISTRATION ADJUSTMENT AMOUNT : ΔA1 TEMP. AT ADJUSTMENT TIME : TA1
REGISTRATION ADJUSTMENT AMOUNT : ΔA2 TEMP. AT ADJUSTMENT TIME : TA2
ADJUSTMENT AMOUNT FIXED AND NOT CALCULATED ONCE TEMPERATURE GRADIENT MODERATES
REGISTRATION ADJUSTMENT AMOUNT (PREDICTION CONTROL)
EXECUTE ADJUSTMENT BY PREDICTION CONTROL(COMPUTE PREDICTED VALUE ACCORDING TO TEMPERATURE)
REGISTRATION ADJUSTMENT AMOUNT : ΔB=0 (0 WHEN PATCH MEASUREMENT ADJUSTMENT EXECUTED)
REGISTRATION ADJUSTMENT AMOUNT : ΔB=αΔT
REGISTRATION ADJUSTMENT AMOUNT : ΔB=0 (0 WHEN PATCH MEASUREMENT ADJUSTMENT EXECUTED)
REGISTRATION ADJUSTMENT AMOUNT : ΔA1+ΔB
REGISTRATION ADJUSTMENT AMOUNT : ΔA2

IMAGE FORMING APPARATUS

BACKGROUND OF THE INVENTION

1. Field of the Invention

The present invention relates to a technology for calculating the amount of misregistration.

2. Description of the Related Art

Image forming apparatuses such as color copiers and printers include tandem image forming apparatuses that are provided with an image forming portion for each color and superimposes toner images of the respective colors to form a color image. With such image forming apparatuses, components such as photosensitive drums and laser scanners become deformed due to the change in temperature of the image forming portions when performing multiple transfers of the different colored toner images, resulting in color misregistered images being formed in which the image formation position of each color is slightly displaced.

In view of this, the following processing is performed in order to correct misregistration of the different colored toner images. First, a patch is formed in each image forming portion, and the amount of misregistration is detected by reading this patch with a sensor. Color registration adjustment for adjusting the image formation timing of each color is then performed based on the detected misregistration amount to thereby prevent formation of color misregistered images.

In a medium-speed or fast-speed color printer of which both image quality and image productivity are required, a considerable amount of heat is needed in order to quickly fix toner images to printing paper. Particularly when the device is powered on from a completely cold state, such as for the first time in the morning, the temperature of the image forming portions (laser scanners, drums, developing units, etc.) inside the device rises rapidly from environmental temperature and approaches the equilibrium temperature of the operating state of the device, while the controller is starting up, device adjustments are being carried out and the fixing unit is warming up. Conventionally, the printer forms the patches and detects the amount of misregistration in this state, and thereafter enters a print ready (standby) state. Although the use of patches to detect the misregistration amount is highly accurate and image quality is kept constant, time is required to form and read the patches, and thus detection cannot be implemented frequently since the user is unable to print during that time and user convenience suffers. Since the temperature of the image forming portions is substantially in equilibrium and changes moderately after the device has warmed up, it is desirable to form the patches at predetermined intervals (every predetermined number of printed sheets or predetermined time period) and detect the amount of misregistration while balancing image quality with user convenience.

With low-speed printers that are mainly for personal use, prediction control that involves storing the relationship between the change in temperature of the device and the amount of misregistration for each color and calculating the adjustment amount by predicting the amount of misregistration according to the change in temperature is mainly used. Although the amount of misregistration can be updated without the user being unable to print, this method is slightly less accurate than the abovementioned detection of misregistration amount performed by forming patches. In Japanese Patent Laid-Open No. 2010-217544, a technology is proposed in which a table indicating amounts of registration adjustment relative to changes in device temperature is stored. Then, when the temperature change is at or below a predetermined value, prediction adjustment based on the adjustment table is performed, and when the temperature change exceeds the predetermined value, the amount of misregistration is measured using patches and the adjustment table is updated.

However, there are the following problems with the above conventional technologies. For example, fixing units capable of warming up on demand with a heating method using induction heating or the like have been developed in recent years in consideration of user convenience. With such image forming apparatuses, high-speed startup is possible even when the device is powered on from a completely cold state, and controller startup and device adjustment operations are also completed and a print ready (standby) state is achieved in approximately 30 seconds. Thus, patches are formed and the amount of misregistration is detected during the period in which the temperature around the image forming portions is rising rapidly from environmental temperature. Since the temperature of the image forming portions continues to rise rapidly for several minutes immediately after startup, image quality deteriorates when printing is performed during this time due to the change in the amount of misregistration that occurs as a result of temperature change after registration adjustment.

On the other hand, prediction of the amount of misregistration can be sufficiently expected to improve during the period in which the temperature is rising rapidly at the beginning of startup. However, in a state where the device has warmed up sufficiently and has stabilized, prediction control results in adjustment accuracy that is inferior to conventional devices that form patches. Also, in the case where the above conventional technologies are applied to a printer with high-speed startup capability, formation of patches and measurement of the amount of misregistration will be frequently performed, since there is a large change in temperature inside the device immediately after startup. Accordingly, even if high-speed startup is performed, image formation will be delayed and user convenience will be adversely affected.

SUMMARY OF THE INVENTION

The present invention enables realization of a mechanism for favorably changing the registration adjustment method in accordance with whether or not there is a significant change in temperature inside the device.

One aspect of the present invention provides an image forming apparatus comprising: an exposure unit configured to expose a photosensitive member in accordance with an image signal and form an electrostatic latent image; a developing unit configured to develop the electrostatic latent image using a toner; a transfer unit configured to transfer a toner image developed by the developing unit to an image carrier; a first sensor configured to measure a temperature of the exposure unit; a determination unit configured to determine whether the temperature of the exposure unit measured by the first sensor is changing at a predetermined gradient or more; a calculation unit configured to calculate a registration adjustment condition; and a registration adjustment unit configured to perform registration adjustment processing based on the registration adjustment condition calculated by the calculation unit, wherein the calculation unit performs calculation processing for calculating the registration adjustment condition based on a result of detecting a position of a patch formed on the image carrier, in a case where the result of the determination by the determination unit indicates that the temperature is not changing at the predetermined gradient or more, and performs prediction processing for predicting the registration adjustment condition based on the temperature of the exposure unit measured by the first sensor, without forming a patch on the image carrier, in a case where the result of the determination by the determination unit indicates that the temperature is changing at the predetermined gradient or more.

Further features of the present invention will be apparent from the following description of exemplary embodiments with reference to the attached drawings.

BRIEF DESCRIPTION OF THE DRAWINGS

FIGS. 4A and 4B are graphs representing changes in temperature/image misregistration during startup of an image forming apparatus.

DESCRIPTION OF THE EMBODIMENTS

Embodiments of the present invention will now be described in detail with reference to the drawings. It should be noted that the relative arrangement of the components, the numerical expressions and the numerical values set forth in these embodiments do not limit the scope of the present invention unless it is specifically stated otherwise.

Configuration of Image Forming Apparatus

Figure 1:
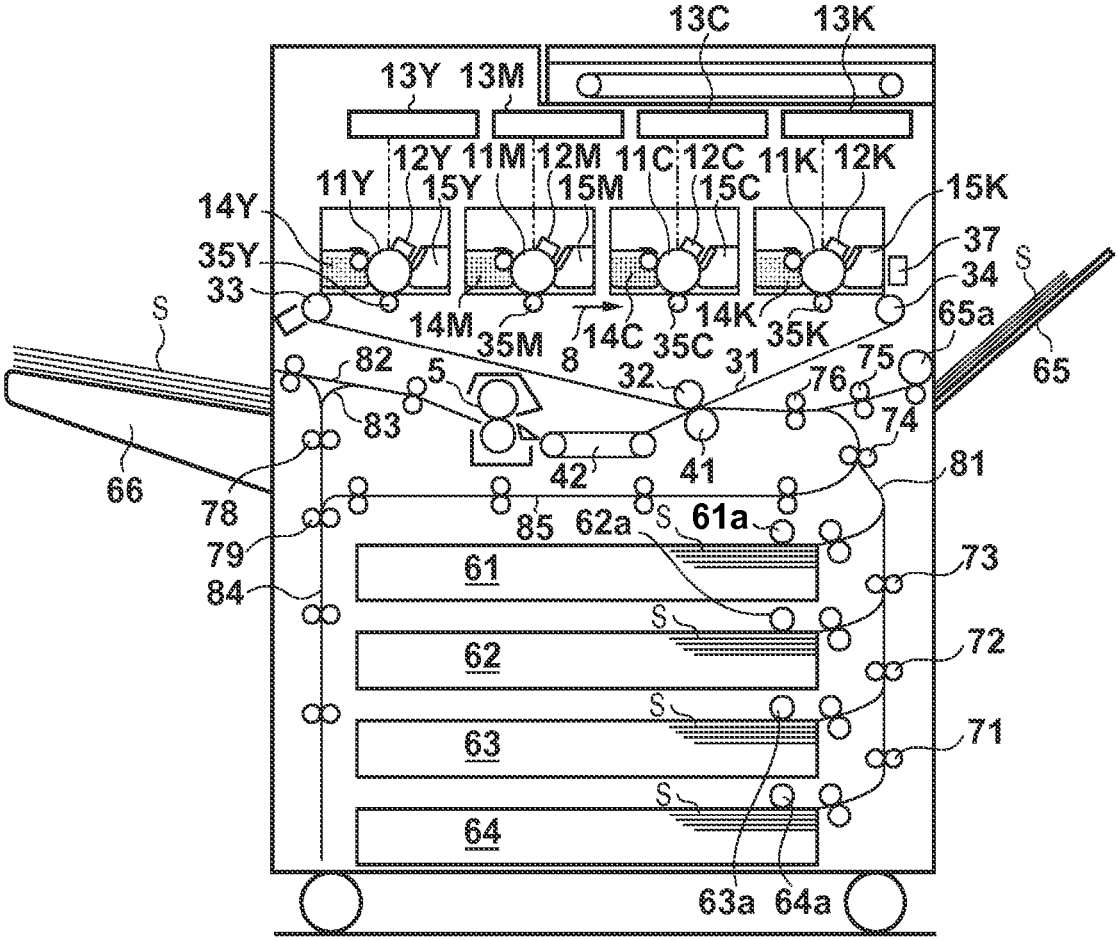
FIG. 1 is a schematic cross-sectional view of an image forming apparatus.

First, a configuration of an image forming apparatus will be described, with reference to FIG. 1. The image forming apparatus in FIG. 1 is a color image forming apparatus using an electrophotographic method. In recent years, an intermediate transfer tandem system in which image forming portions of four colors are disposed side-by-side on an intermediate transfer belt has become mainstream given the advantages of having excellent print productivity and adaptability to a diverse range of printing paper. Note that the present invention can also be applied to a tandem image forming apparatus that do not have an intermediate transfer belt, that is, that performs direct transfer to printing paper.

Printing Paper Conveyance Process

Printing paper S is stored by being stacked in printing paper repositories 61 to 65, and the printing paper S is supplied by feed portions 61*a* to 65*a* in accordance with the image formation timing. Printing paper denotes printing media for having images formed thereon, and is used here to include all printing media capable of being conveyed in an image forming apparatus, such as plain paper, OHP sheets, heavy paper and the like. The printing paper S fed out by the feed portions (feed rollers) 61*a* to 65*a* passes through a conveyance path 81 and the like, and is conveyed to a pair of registration rollers 76 serving as a pre-transfer conveyance portion. The pair of registration rollers 76 have a function of aligning the leading edge of the printing paper S and correcting skew, by creating a loop so that the printing paper S that is conveyed from the printing paper repositories 61 to 65 strikes the pair of registration rollers. Furthermore, after correcting for skew, the pair of registration rollers 76 convey the printing paper S to a secondary transfer portion at the timing at which an image is formed on the printing paper S, that is, at a predetermined timing to coincide with the toner images carried on an image carrier. The secondary transfer portion is a nip portion for transferring toner images to the printing paper S that is formed by an inner secondary transfer roller 32 and an outer secondary transfer roller 41 that oppose each other, the outer secondary transfer roller 41 being removably supported with respect to the inner secondary transfer roller 32. Toner images are transferred to the printing paper S by applying a predetermined pressure and electrostatic load bias in the secondary transfer portion.

Image Formation Process

The process of forming an image sent to the secondary transfer portion at the same timing with respect to the process of conveying the printing paper S to the secondary transfer portion described above will be described. The image forming portions are mainly constituted by a photosensitive member 11 (11Y, 11M, 11C, 11K), a charging unit 12 (12Y, 12M, 12C, 12K), an exposure unit 13 (13Y, 13M, 13C, 13K), a developing unit 14 (14Y, 14M, 14C, 14K), a primary transfer unit 35 (35Y, 35M, 35C, 35K), a photosensitive member cleaner 15 (15Y, 15M, 15C, 15K), and the like. The exposure unit 13 is driven based on image information signals that are sent, with respect to the rotating photosensitive member 11 whose surface is uniformly charged in advance by the charging unit 12, and an electrostatic latent image is formed on the photosensitive member 11. The electrostatic latent image formed on the photosensitive member 11 undergoes developing with toner in the developing unit 14 and is actualized as a toner image on the photosensitive member 11. Thereafter, a predetermined pressure and electrostatic load bias are applied by the primary transfer unit 35, and a toner image is transferred to an intermediate transfer belt 31. Then, the small amount of residual transfer toner that remains on the photosensitive member 11 is recovered by the photosensitive member cleaner 15 in readiness of the next image formation. The image forming portion described above is, in the case of FIG. 1, provided as a set of four image forming portions of the colors yellow (Y), magenta (M), cyan (C) and black (Bk). It should be obvious that the number of colors is not limited to four, and that the order in which the colors are arranged in not limited to the stated order.

Next, the intermediate transfer belt 31 will be described. The intermediate transfer belt 31 is supported in a tensioned state by rollers including a driving roller 33 that rotationally drives the intermediate transfer belt 31, a steering roller 34 that adjusts a thrust position of the intermediate transfer belt 31, and the inner secondary transfer roller 32, and is driven so as to be conveyed in the direction of arrow B in the diagram. The image formation processes of the different colors that are carried out in parallel by the previously discussed Y, M, C and Bk image forming portions are respectively performed at a timing that allows each toner image to be superimposed on the toner image of the upstream color that has undergone primary transfer to the intermediate transfer belt 31. As a result, a full color toner image is ultimately formed on the intermediate transfer belt 31, and this full color toner image is conveyed to the secondary transfer portion.

Secondary Transfer Process and Subsequent Processes

In the secondary transfer portion, the full color toner image undergoes secondary transfer to the printing paper S after having passed through the respective processes described above; that is, the process of conveying the printing paper S and the image formation process. Thereafter, the printing paper S is conveyed to a fixing unit 5 by a suction conveyance portion 42. The suction conveyance portion 42 conveys the printing paper by air suction using a fan or the like. The fixing unit 5 applies a predetermined pressure using opposing rollers, a belt or the like and generally a heating effect using a heat source such as a heater to fuse and fix the toner image to the printing paper S. Path selection is then performed in order to convey the printing paper S having the fixed image thus obtained on a discharge conveyance path 82 for discharging the printing paper S directly into a delivery tray 66 or on a reverse guidance path 83 in the case of performing double-sided image formation. When performing double-sided image formation, the printing paper S is drawn into a switchback path 84 from the reversal guidance path 83, the leading and trailing edges are switched around by reversing the rotation direction of a pair of reverse B rollers 79 (by performing a switchback operation), and the printing paper S is conveyed to a double-sided conveyance path 85. Thereafter, the printing paper S merged back in at the timing at which the printing paper S of the subsequent job would be conveyed from the feed portions, and is similarly sent to the secondary transfer portion via the pair of registration rollers 76. Because the image formation process on the back side (second side) is the same as the case of the front side (first side) discussed previously, description thereof is omitted. Also, when reverse discharging the printing paper S, a pair of reverse A rollers 78 and the pair of reverse B rollers 79 are driven in reverse after the printing paper S has been drawn into the switchback path 84 from the reverse guidance path 83 after passing through the fixing unit 5. The trailing edge when the printing paper S was drawn in thereby becomes the leading edge, and the printing paper S is sent out in the opposite direction to the direction in which it was drawn in, and discharged into the discharge tray 66.

Image Registration adjustment Control

Next, image registration adjustment control will be described, with reference to FIGS. 5 and 6. There are, broadly speaking, the following two adjustment methods for correcting image misregistration between the different colors in a tandem image forming apparatus that is provided with image forming portions for four colors and performs multiple transfers on the intermediate transfer belt 31.

Figure 6:
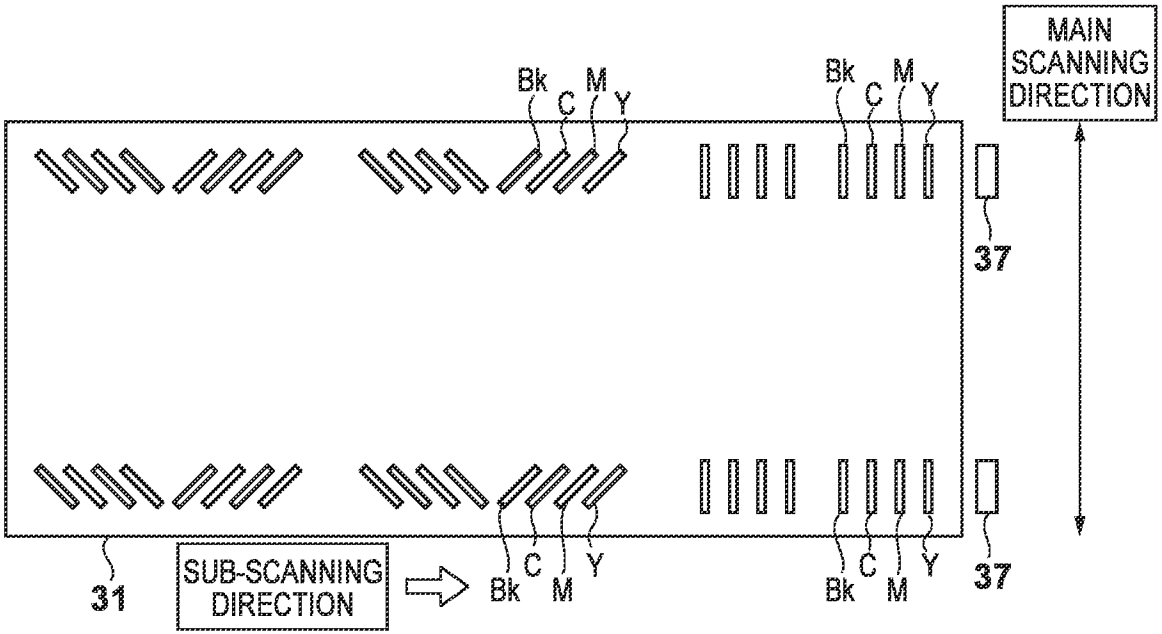
FIG. 6 is a diagram showing patches.
Figure 7:
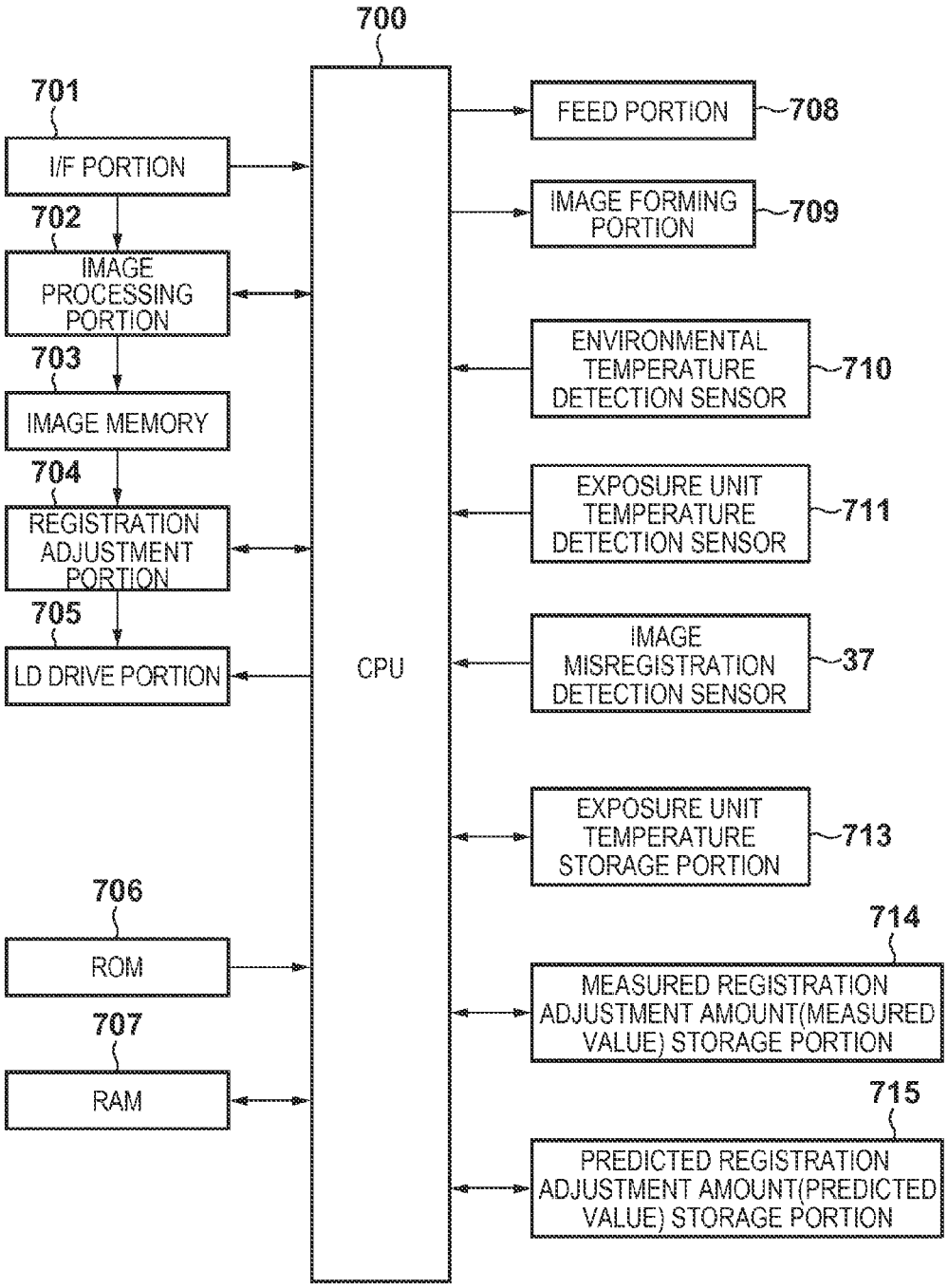
FIG. 7 is a block diagram of an image forming apparatus according to a first embodiment.

The first registration adjustment method (measured registration adjustment) involves forming patches of the different colors such as shown in FIG. 6 on the intermediate transfer belt 31, reading these patches with an image misregistration detection sensor 37, and correcting misregistration by calculating the amount of misregistration from the sensor output. The calculated amount of misregistration is stored in a registration adjustment amount storage portion as a measured registration adjustment amount. The image write start timing of the exposure unit 13 is corrected, based on this stored measured registration adjustment amount. This adjustment method is able to correct image misregistration with very high accuracy. However, in order to form a plurality of patch images of four different colors and reduce the influences of thickness unevenness in the circumferential direction of the intermediate transfer belt 31 and detection error of the image misregistration detection sensor 37 as much as possible, a plurality of the same patches are created over at least one revolution of the intermediate transfer belt 31 and the sensor output is averaged. Thus, the total time taken to perform the registration adjustment control is increased. In other words, the state in which the user is not able to use the image forming apparatus due to "adjustment-in-progress" is extended.

The second registration adjustment method (predicted registration adjustment) involves storing the relationship of amounts of image misregistration according to changes in temperature of the exposure unit 13, predicting the temperature change of the exposure unit 13 based on the elapsed time from when the image forming apparatus was powered on, the operating state of the image forming apparatus during that period, and the like, and predicting the amount of misregistration based on the predicted temperature change. Specifically, the amount of misregistration corresponding to the predicted temperature change is derived from the stored relationship and stored in the registration adjustment amount storage portion as a predicted registration adjustment amount, and the image write start timing of the exposure unit 13 is corrected based on the stored registration adjustment amount. Since the second registration adjustment method is able to derive the registration adjustment amount without forming patches, at no time the user will be unable to use the image forming apparatus. However, the mutual relationship between temperature change and image misregistration amount is derived completely from typical data, and error occurs between the predicted and actual amounts of image misregistration due to individual differences between image forming apparatuses and various situations that arise during actual operation.

Figure 5A:
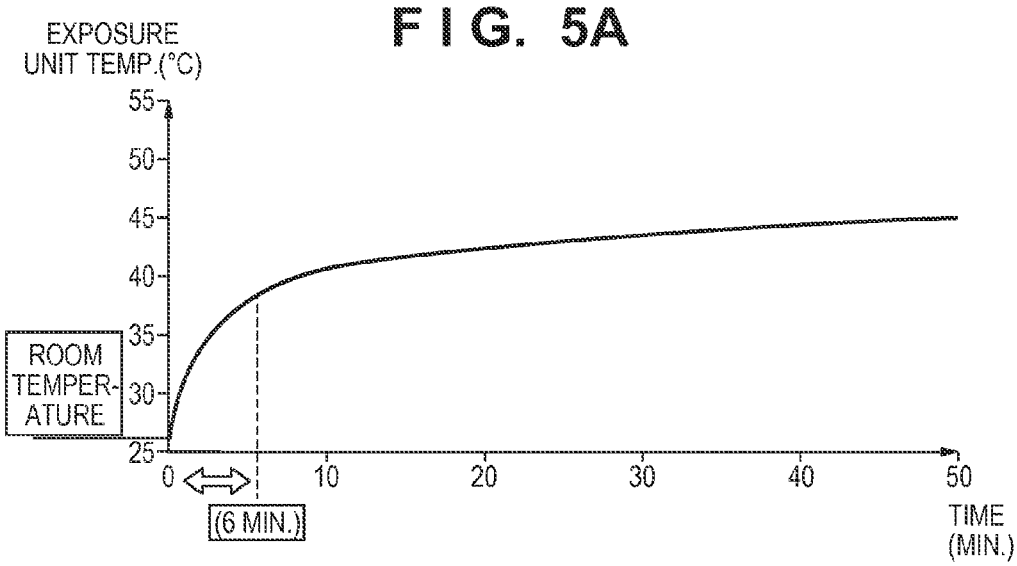
FIGS. 5A to 5C are graphs showing temperature change and change in misregistration in a main scanning direction of an exposure unit.
Figure 5B:
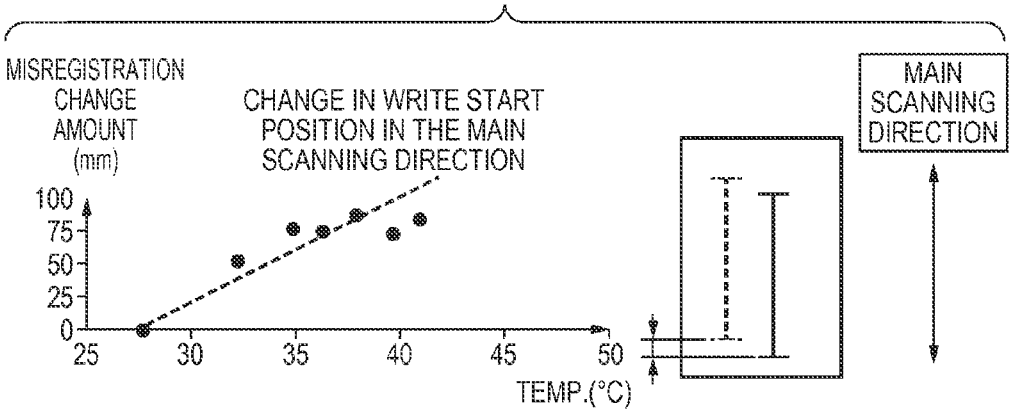
Figure 5C:
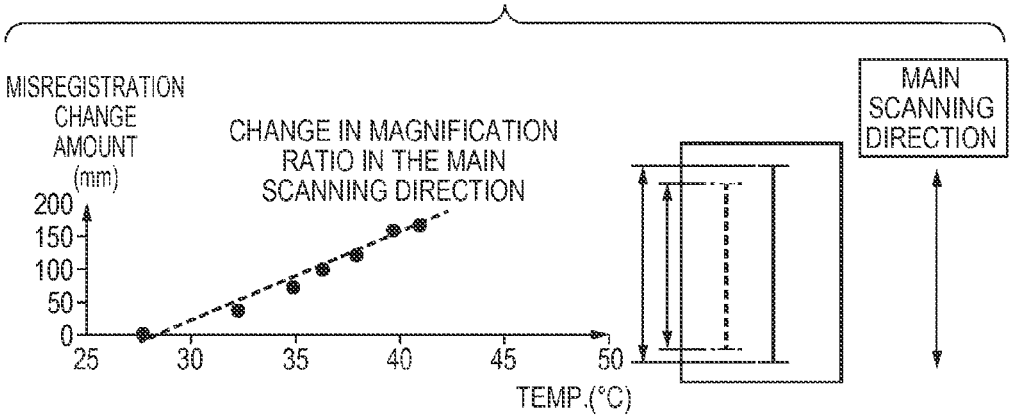

Prediction error can be reduced by adding a temperature detection portion to the exposure unit 13 and measuring rather than predicting the temperature of the exposure unit 13 as shown in FIG. 5A. However, since the average amount of misregistration is predicted based on the mutual relationship between the temperature of the exposure unit 13 and the amount of misregistration as shown in FIGS. 5B and 5C, the accuracy of registration adjustment is low when compared with the first registration adjustment method (measured registration adjustment).

Registration adjustment Control in Image Forming Apparatus capable of High-Speed Startup Hereinafter, image registration adjustment control in an image forming apparatus capable of high-speed startup will be described with reference to FIGS. 2A to 8B.

Figure 2A:
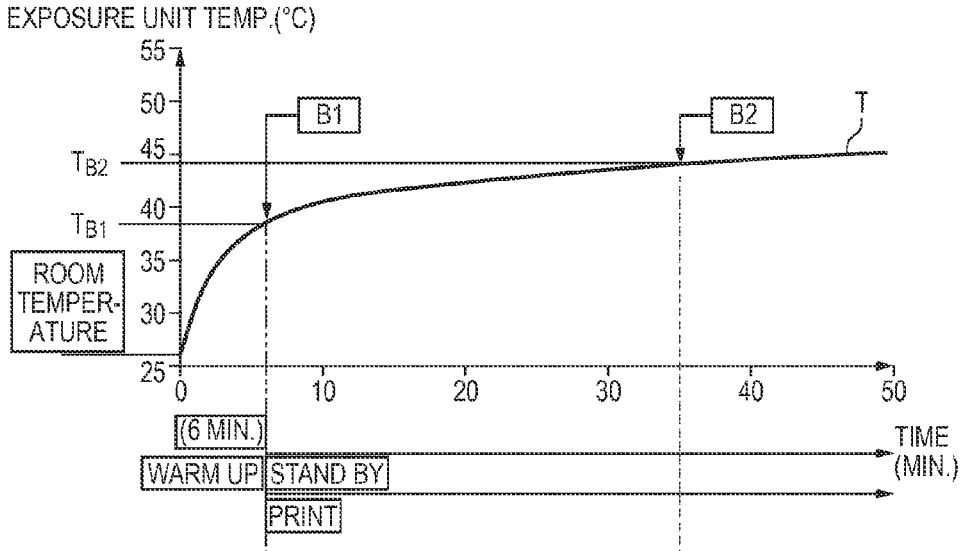
FIGS. 2A and 2B are graphs representing changes in temperature/image misregistration during startup of an image forming apparatus serving as a comparative example.

First, the change in temperature of the exposure unit and the change in image misregistration during startup of an image forming apparatus serving as a comparative example will be described, with reference to FIGS. 2A and 2B. The image forming apparatus serving as a comparative example is not capable of high-speed startup. FIG. 2A shows the power-on timing of the image forming apparatus as 0 minutes and the subsequent elapse of time on the horizontal axis, and shows the change in temperature T of the exposure unit 13 on the vertical axis.

In an image forming apparatus that prioritizes high volume printing such as office and quick printing as well as the productivity and image quality of such printing, very large amounts of heat are required in order to fix toner to printing paper in a short time. Accordingly, in the case where the image forming apparatus starts up from a completely cold state, such as when the device is powered on for the first time in the morning, the fixing unit needs to be warmed up to a predetermined temperature. With the image forming apparatus serving as a comparative example, it takes about 6 minutes to reach a state in which printing can be started (standby state). First, the temperature inside the image forming apparatus rises rapidly (at a predetermined gradient or more) from a state in which the inside of the image forming apparatus is completely cold. At the timing (A1) at which warm up of the fixing unit is completed, the temperature of the exposure unit 13, which is sensitive to the amount of image misregistration, will be substantially in equilibrium. This is because rising temperature caused by self-generated heat from the exposure unit due to power being supplied and an increase in temperature inside the image forming apparatus is balanced with cooling by a cooling system inside the image forming apparatus, and the temperature gradient moderates.

Figure 2B:
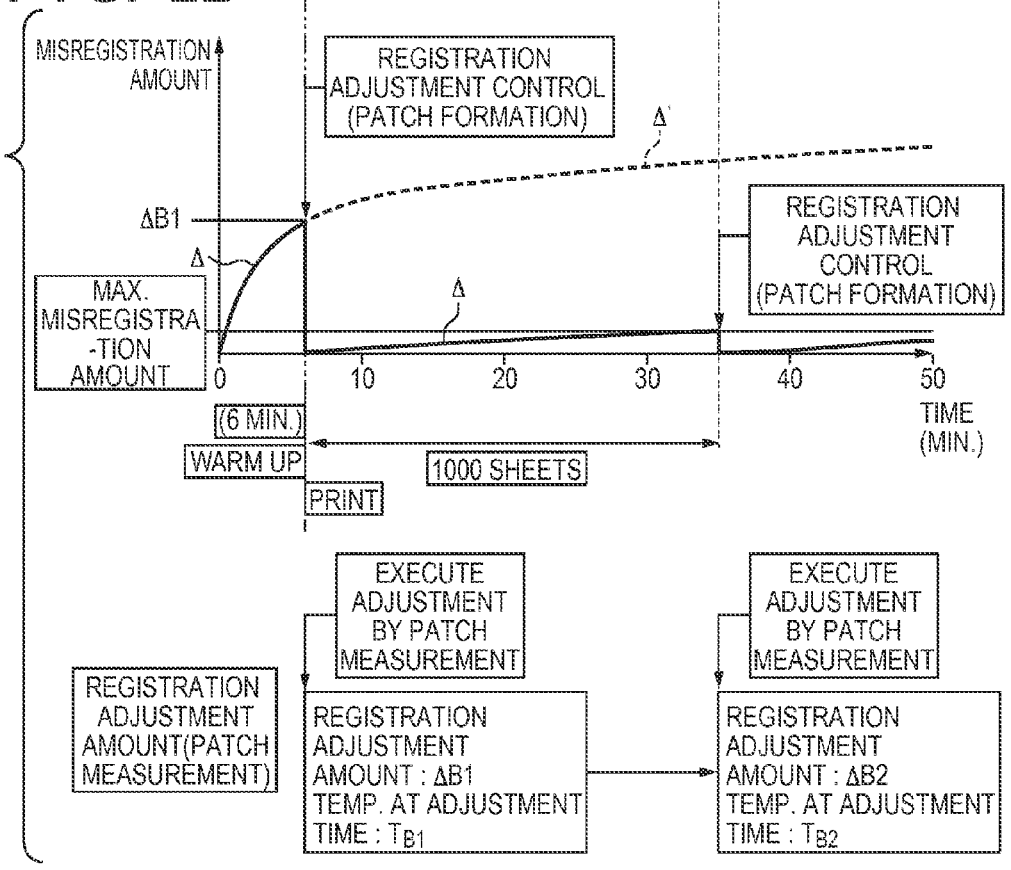

FIG. 2B shows the power-on timing as 0 minutes and the subsequent elapse of time on the horizontal axis as in FIG. 2A, and the misregistration amount Δ on the vertical axis. During warm up, the misregistration amount Δ increases with the rapid rise in temperature of the exposure unit 13, as shown in FIG. 2B. Then, at the timing (B1) at which the warm up is completed, the temperature of the exposure unit 13 is TB1 and the misregistration amount Δ is ΔB1. At this timing, the misregistration amount ΔB1 is measured by forming and reading patches. The registration adjustment amount is calculated based on the result of the reading and stored in memory. The image forming apparatus will then be ready to start printing (standby state). Since adjustment is applied based on this registration adjustment amount when printing is subsequently performed, misregistration of output images immediately after warm up will be substantially 0. Temperature change of the exposure unit 13 will have moderated after calculation of this registration adjustment amount, and formation of the original patches, measurement of the misregistration amount and computation of the registration adjustment amount is performed again during printing operation, at a timing (B2) such as when the number of printed sheets reaches a predetermined number of sheets (e.g., 1000 sheets), for example. Image formation can thereby always be performed with stable accuracy.

Figure 3A:
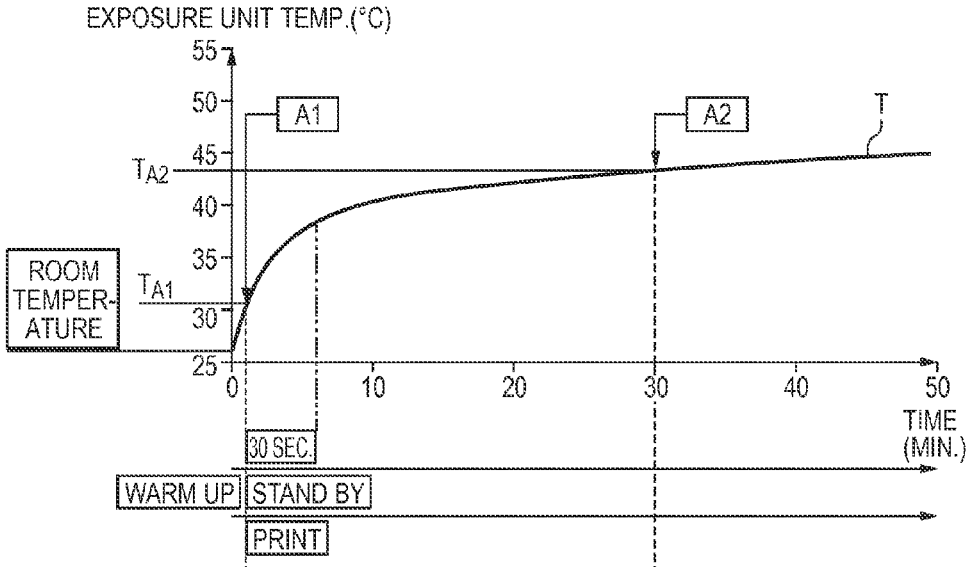
FIGS. 3A and 3B are graphs representing changes in temperature/image misregistration during startup of an image forming apparatus capable of high-speed startup.

Next, the change in temperature of the exposure unit and the change in image misregistration during startup of an image forming apparatus capable of high-speed startup will be described, with reference to FIGS. 3A and 3B. FIG. 3A shows the power-on timing of the image forming apparatus as 0 minutes and the subsequent elapse of time on the horizontal axis, and shows the change in temperature T of the exposure unit 13 on the vertical axis.

Nowadays, the use of electromagnetic induction heating (IH) for the heater of the fixing unit means that the warm up time of the fixing unit is short, given the good heat efficiency and quick startup. The startup time of the controller is also dramatically shortened. Therefore, with such image forming apparatuses, high-speed startup that requires only approximately 30 seconds from power on to standby is realized. However, even if the time for the temperature of the fixing unit to increase is shortened, to print at high speed while also maintaining high image quality, there is no reduction in the required amount of heat that is applied to the toner on the printing paper. In other words, there is no change in the temperature of the exposure unit at which rising temperature caused by self-generated heat from the exposure unit due to power being supplied and an increase in temperature inside the image forming apparatus is balanced with cooling by the cooling system inside the image forming apparatus. Accordingly, the increase in temperature inside an image forming apparatus capable of high-speed startup and the change in temperature T of the exposure unit 13 under the influence of this increase in temperature are not significantly different from the image forming apparatus serving as a comparative example (FIGS. 2A and 2B) as shown in FIG. 3A. In other words, even though an image forming apparatus capable of high-speed startup requires only approximately 30 seconds for warm up of the fixing unit to be completed, the temperature of the exposure unit 13 continues to rise rapidly after that.

Figure 3B:
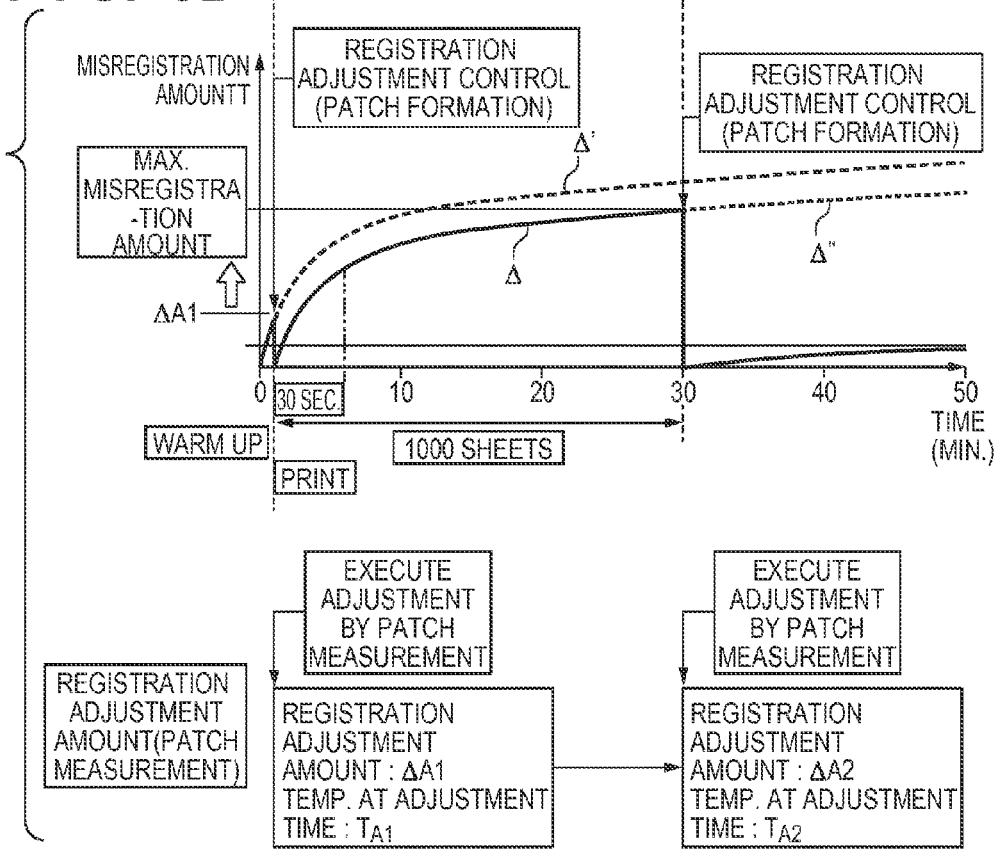

FIG. 3B shows the power-on timing as 0 minutes and the subsequent elapse of time on the horizontal axis, and shows the amount of image misregistration Δ on the vertical axis. Here, from power on to standby can be achieved in a short time, by executing measured registration adjustment at the point in time that warm up of the fixing unit is completed. At the point in time that measured registration adjustment is executed, the temperature of the exposure unit 13 is $T_{A1}$ as shown in FIG. 3B, and the measured misregistration amount that is detected will be ΔA1. The measured registration adjustment amount calculated based on the measured misregistration amount is then stored in memory, and the image forming apparatus is ready to start printing (standby state).

However, as shown in FIG. 3B, since the temperature gradient of the exposure unit 13 is still steep at the timing at which the fixing unit has warmed up (about 30 seconds from the image forming apparatus being started up as shown by A1 in FIG. 3A), the misregistration amount Δ continues to increase immediately after the image forming apparatus has entered the standby state. In other words, the error between the measured misregistration amount and the actual misregistration amount continues to increase. Therefore, if registration adjustment control is performed based on the measured registration adjustment amount during printing operation after the image processing apparatus has entered the standby state, image misregistration will arise in the output image.

An image forming apparatus capable of high-speed startup achieves a short waiting time until the user is able to print. On the other hand, however, image misregistration will deteriorate from when the amount of misregistration was measured at the time of startup until when the amount of misregistration is next measured.

Naturally, this can be avoided by measuring the amount of misregistration again when a user is going to print after the image forming apparatus has entered the standby state, if there is a large change in the temperature of the exposure unit 13 from when the amount of misregistration was measured. However, since the exposure unit 13 has a steep temperature gradient for about 6 minutes after startup as shown in FIG. 3B, measurement of the misregistration amount will be performed every time a user attempts to print, resulting in waiting time. In other words, the advantage of the high-speed startup capability is reduced for the user.

During the period in which the temperature of the exposure unit 13 immediately after startup is increasing rapidly (segment indicated by white double arrow in FIG. 5A) that is being focused on, the amount of misregistration can be predicted with high accuracy from the temperature change. In other words, the amount of image misregistration can be reduced to conventional levels, even without measuring the amount of misregistration. This is because the inside of the apparatus and the exposure unit 13 do not achieve temperature equilibrium, and the temperature will reliably continue to rise at a steep gradient, with little variation in the temperature change. For example, as shown in FIGS. 5B and 5C, the amount of misregistration reliably increases in the case where the temperature changes 5 to 10 degrees, and exhibits a tendency to approximate a straight line as indicated by the dotted line. In other words, in the case where the temperature change has a steep gradient, the correlativity of the actual amount of misregistration and the predicted misregistration amount is high.

However, with the abovementioned second adjustment method (predicted registration adjustment) for predicting the amount of misregistration from the change in temperature, prediction accuracy falls when the temperature inside the image forming apparatus achieves equilibrium. In other words, once the temperature gradient has moderated the temperature repeatedly rises and falls slightly according to the operating state of the image forming apparatus, and in the case of a change of about 1 to 2 degrees the correlativity between the actual amount of image misregistration and the predicted amount of image misregistration decreases. Therefore, performing registration adjustment based on the predicted misregistration amount may possibly even result in an increase in image misregistration. This is because when the temperature of the exposure unit approaches equilibrium, the degree of influence exerted by temperature change of the developing unit 14 and the like, for example, increases relatively. Therefore, when the temperature of the exposure unit 13 falls slightly, the amount of misregistration no longer changes in the manner predicted due to the influences of the temperature of developing unit.

First Embodiment

Control Configuration of Image Forming Apparatus

A first embodiment will be described with reference to FIGS. 4A, 4B, 7, 8A and 8B. First, the control configuration of an image forming apparatus according to the present embodiment will be described, with reference to FIG. 7.

The image forming apparatus includes, as the main control configuration according to the present invention, a CPU 700, an I/F (interface) portion 701, an image processing portion 702, an image memory 703, a registration adjustment portion 704, an LD drive portion 705, a ROM 706, a RAM 707, a feed portion 708, an image forming portion 709, an environmental temperature detection sensor (second sensor) 710, an exposure unit temperature detection sensor (first sensor) 711, an image misregistration detection sensor 37, an exposure unit temperature storage portion 713, a measured registration adjustment amount (measured value) storage portion 714, and a predicted registration adjustment amount (predicted value) storage portion 715. The CPU 700 is connected to the respective components and performs overall control of the image forming apparatus. The ROM 706 is a memory in which programs such as a control program and a boot program that are executed by the CPU 700, setting parameters and the like are stored. The RAM 707 is a memory that is used as a work area of the CPU 700.

The I/F portion 701 is connected to an external apparatus and receives image data or the like. The image processing portion 702 performs various image processing on image data received via the I/F portion 701. Image data output from the image processing portion 702 is stored in the image memory 703. The registration adjustment portion 704 performs registration adjustment processing on image signals output to the exposure unit 13, using the first adjustment method and the second adjustment method. The LD drive portion 705 drives the exposure unit 13 in accordance with image signals output from the registration adjustment portion 704.

The feed portion 708 controls feeding of the printing paper S. The image forming portion 709 controls the loads shown in FIG. 1, and executes image formation processing. The environmental temperature detection sensor 710 is a sensor that measures the temperature of the environment in which image forming apparatus is placed. The exposure unit temperature detection sensor 711 is a sensor that detects the temperature of the exposure unit 13. The image misregistration detection sensor 37 is a sensor that detects formed patch images.

The exposure unit temperature storage portion 713 is an area for storing the temperature of the exposure unit 13 detected by the exposure unit temperature detection sensor. The measured registration adjustment amount (measured value) storage portion 714 is an area for storing the measured registration adjustment amount (measured value) calculated from the misregistration detected by the image misregistration detection sensor 37 from formed patches. The predicted registration adjustment amount (predicted value) storage portion 715 is an area for storing the predicted registration adjustment amount (predicted value) calculated in accordance with the temperature of the exposure unit 13 detected by the exposure unit temperature detection sensor.

Startup Sequence

Figure 8A:
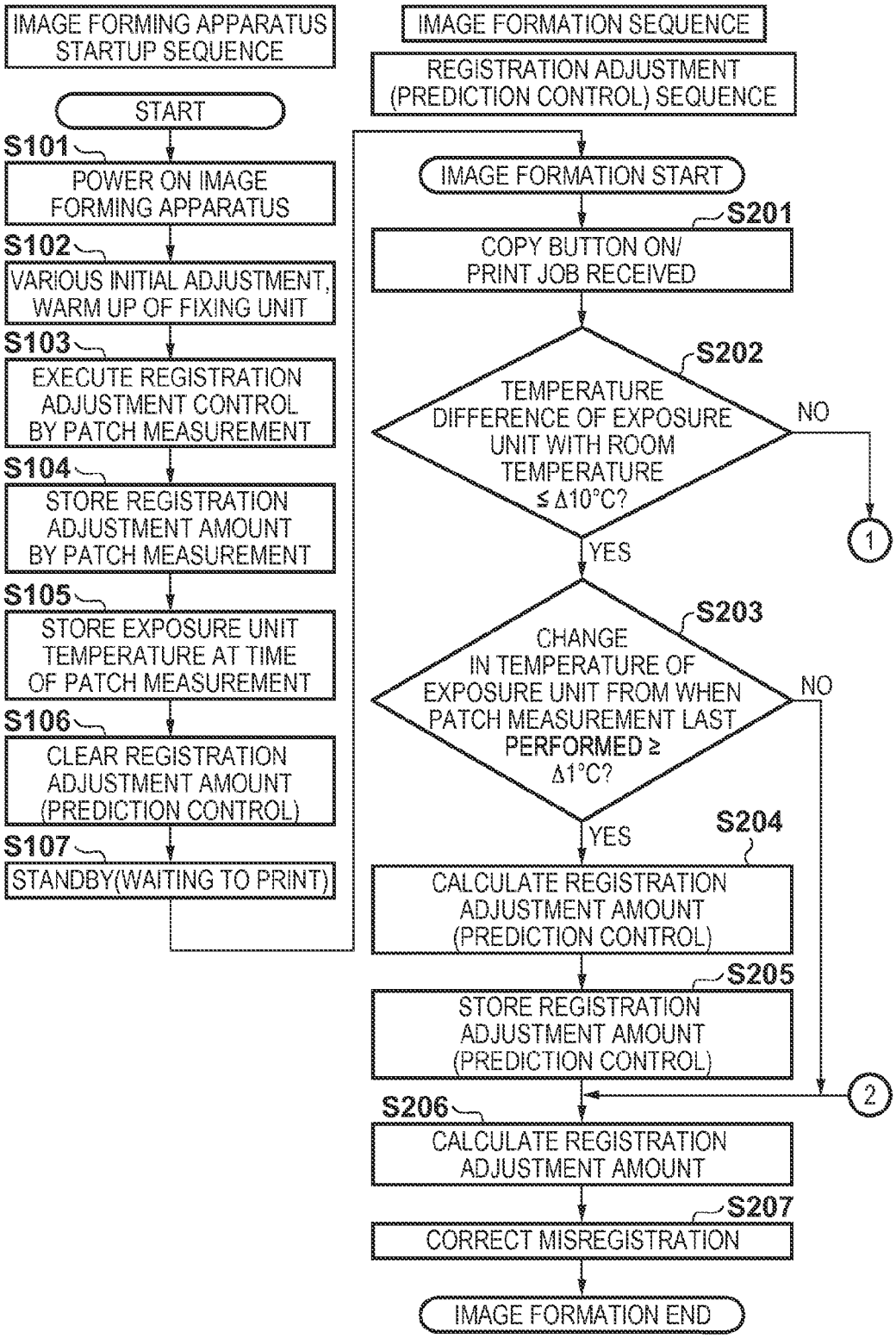
FIGS. 8A and 8B are flowcharts showing processing procedures of the image forming apparatus according to the first embodiment.
Figure 8B:
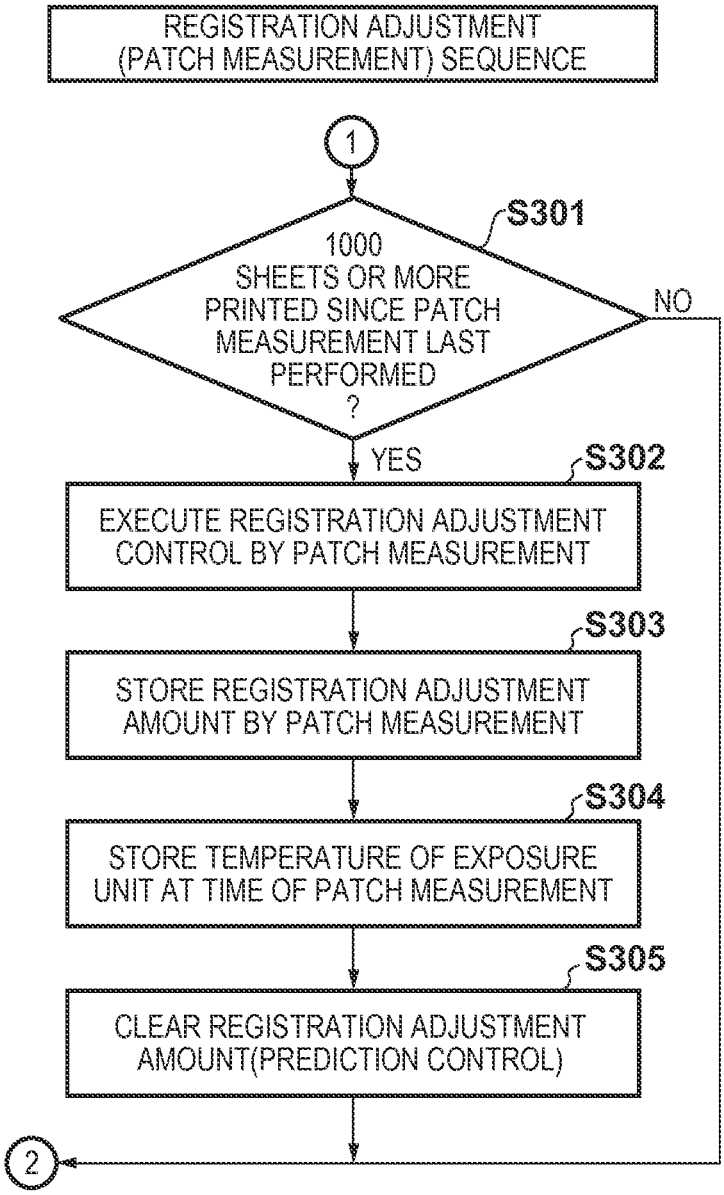

Next, the startup sequence (S101-S107) of the image forming apparatus according to the present embodiment will be described, with reference to FIGS. 8A and 8B. The processing described below is realized by the CPU 700 reading out the control program stored in the ROM 706 to the RAM 707 and executing the control program. Note that the following description proceeds assuming startup from a state in which the image forming apparatus is completely cold such as for the first time in the morning.

First, in S101, the CPU 700 detects that the image forming apparatus has been powered on. Next, in S102, the CPU 700 starts the warm up of the fixing unit 5 at the same time as starting various adjustments. In S103, after the warm up of the fixing unit 5 has ended, the CPU 700 forms the patches of the different colors shown in FIG. 6 on the intermediate transfer belt 31, reads these patches with the image misregistration detection sensor 37, detects the measured misregistration amount, and calculates the measured registration adjustment amount. Furthermore, the CPU 700 stores the measured registration adjustment amount that was calculated in the measured registration adjustment amount (measured value) storage portion 714 in S104, and stores an output TA from the exposure unit temperature detection sensor at point in time that the patches were measured in the exposure unit temperature storage portion 713 in S105. Thereafter, the CPU 700 clears the data of the predicted registration adjustment amount (predicted value) storage portion 715 in S106, and transitions to a print ready state (standby state) and waits at S107.

Image Formation Sequence

Next, the image formation sequence S201 to S209 will be described, with reference to FIGS. 4A, 4B, 8A and 8B. The processing described below is realized by the CPU 700 reading out the control program stored in the ROM 706 to the RAM 707 and executing the control program.

Figure 4A:
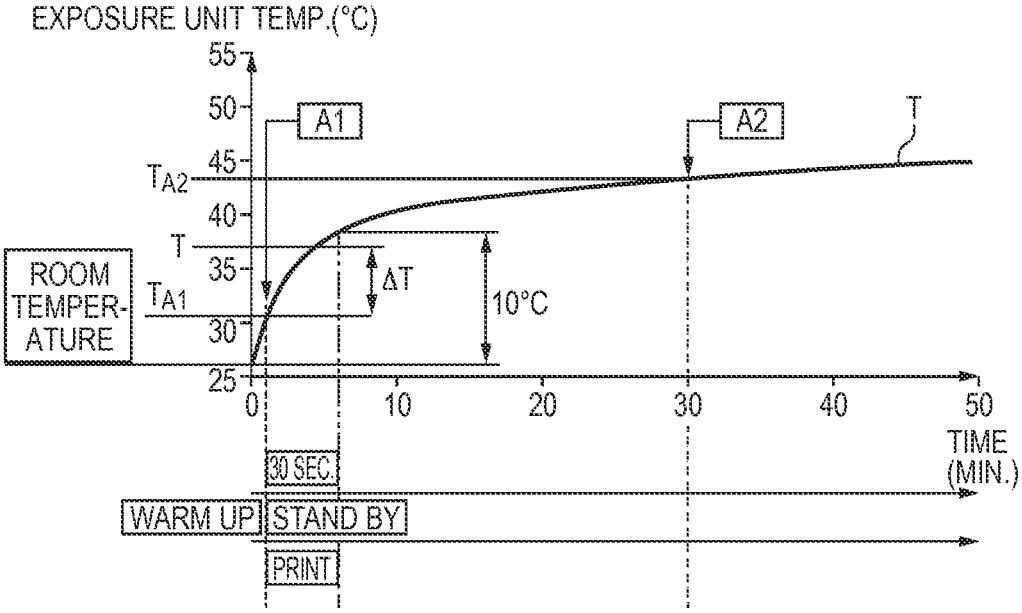

FIG. 4A shows the power-on timing of the image forming apparatus as 0 minutes and the subsequent elapse of time on the horizontal axis, and shows the change in temperature T of the exposure unit 13 on the vertical axis. Also, FIG. 4B shows the power-on timing of the image forming apparatus as 0 minutes and the subsequent elapse of time on the horizontal axis, and shows the misregistration amount Δ on the vertical axis. The following description proceeds assuming printing is performed for about 6 minutes (segment indicated by white double arrow in FIG. 4B) from immediately after startup, which is when the aforementioned image misregistration is an issue.

The CPU 700, in S201, detects that the user has set an original document and pressed the copy button or that a print job has been received from a PC via the I/F portion 701, and then proceeds to S202. The exposure unit 13 has a steep temperature gradient for the period of time shown by A1 (6-minute mark) in FIG. 4A, and if adjustment is performed using the registration adjustment amount calculated at S103, the amount of misregistration will increase along the curve shown by Δ" in FIG. 4B. In view of this, the CPU 700, in S202, compares the current temperature of the exposure unit 13 obtained from the exposure unit temperature detection sensor 711 with the environmental temperature detected by the environmental temperature detection sensor 710, and determines whether the difference is less than or equal to 10 degrees. If the difference is less than or equal to 10 degrees, it is judged to be immediately after startup (corresponds to 30 sec-6 min period in FIG. 4A), and the registration adjustment (predicted registration adjustment) sequence (S203-S205) is executed using the second registration adjustment method.

This is because the exposure unit 13 of the present embodiment has a steep temperature gradient of up to "environmental temperature+10 degrees", this being a value that is set as appropriate in accordance with the temperature characteristics of the image forming apparatus to which the present invention is applied. This determination of S202 is to determine whether to perform registration adjustment using the second registration adjustment method, and the processing advances to S203 if this condition (judgment criterion) is satisfied.

In S203, the difference between the temperature T of the exposure unit 13 obtained from the present exposure unit temperature detection sensor 711 and the temperature $T_{A1}$ of the exposure unit 13 when the misregistration amount stored in the exposure unit temperature storage portion 713 was measured is calculated, this difference corresponding to ΔT in FIG. 4A. The CPU 700 then determines whether the difference ΔT is greater than or equal to a predetermined value (e.g., ≥1° C.). If the difference is not greater than or equal to the predetermined value, the processing proceeds to S206. On the other hand, if the difference is greater than or equal to the predetermined value, the processing proceeds to S204, and the predicted misregistration amount is calculated using the following equation.

$$\text{predicted registration adjustment amount}=\alpha\times\Delta T\alpha$$

This is a predetermined adjustment coefficient, and is derived from a plurality of measured values.

The predicted registration adjustment amount in the present embodiment is a value indicating the amount of change from the measured misregistration amount, as is evident from the fact that the predicted value is calculated from ΔT. Note that there are different types of misregistration, such as misregistration of the write start position in the main scanning direction and misregistration of the magnification ratio in the main scanning direction. Exemplary change of the write start position in the main scanning direction is shown in FIG. 5B, and exemplary change of the magnification ratio in the main scanning direction is shown in FIG. 5C. Thus, the degree of change relative to temperature differs according to the type of misregistration. Therefore, when deriving the predicted registration adjustment amount, the amount of misregistration can be estimated with greater accuracy, by setting a adjustment coefficient for each type of misregistration, and calculating the predicted registration adjustment amount using the following equations.

$$\text{predicted registration adjustment amount(magnification ratio in main scanning direction)}=\alpha 1\times\Delta T$$

$$\text{predicted registration adjustment amount(write start position in main scanning direction)}=\alpha 2\times\Delta T$$

Note that the magnification ratio in the main scanning direction and the write start position in the main scanning direction are highly sensitive to changes in temperature of the exposure unit 13. Therefore, a configuration may be adopted in which only misregistration relating to the main scanning direction is targeted for predicted registration adjustment, and prediction is not performed with respect to the misregistration in the sub-scanning direction. In other words, a configuration may be adopted in which registration adjustment is performed using the predicted misregistration amount with respect to the magnification ratio in the main scanning direction and the write start position in the main scanning direction, while the measured misregistration amount continues to be used for the sub-scanning position rather than using the predicted misregistration amount. The type of misregistration to which to apply predicted registration adjustment should, however, be selected as appropriate in accordance with the characteristics of the image forming apparatus.

Next, in S205, the CPU 700 calculates the predicted misregistration amount which is predicted by the above equation and the registration adjustment amount (predicted value), and stores the calculated values in the predicted registration adjustment amount (prediction control) storage portion 715.

Then, in S206, the CPU 700 derives the registration adjustment amount (registration adjustment condition) based on the following equation.

$$\text{registration adjustment amount}=\text{measured registration adjustment amount}+\text{predicted registration adjustment amount}$$

Because the predicted registration adjustment amount is a value indicating the amount of change from the measured misregistration amount, the current registration adjustment amount is derived by adding the predicted registration adjustment amount to the measured registration adjustment amount.

In S207, the CPU 700 implements registration adjustment on the image information that is input from the I/F portion 701 and stored in the image memory 703 after being image processed by the image processing portion 702. Specifically, the LD drive portion 705 corrects the image signal based on the adjustment amount read from the measured registration adjustment amount (measured value) storage portion 714 and the adjustment amount read from the predicted registration adjustment amount (predicted value) storage portion 715. Specifically, the LD drive portion 705 drives the exposure unit 13 and forms an image using image information stored in the image memory 703, in accordance with a timing based on these registration adjustment amounts. If the formed image is not an image of the last page, the processing then returns to S202.

When the image forming apparatus is used continuously, the temperature of the exposure unit 13 will continue to rise, until finally the difference between the temperature of the exposure unit 13 obtained from the exposure unit temperature detection sensor 711 and room temperature detected by the environmental temperature detection sensor 710 exceeds 10 degrees. In FIG. 4A, this occurs after 6 minute. In this state, the temperature gradient of the exposure unit 13 will have moderated, and if there are temperature changes of 1 degree or so, the correlativity between the actual amount of image misregistration and the predicted amount of image misregistration will be reduced, with the amount of misregistration possibly even increasing due to adjustment being implemented depending on the case. Accordingly, calculation of the measured registration adjustment amount (S302-S305) is executed, rather than executing calculation of the predicted registration adjustment amount (S203-S205). In other words, if it is determined that the difference exceeds 10 degrees in the determination of S202, the processing proceeds to S301.

First, in S301, the CPU 700 distinguishes whether the number of sheets printed after the measured registration adjustment amount was last calculated is greater than or equal to a predetermined number of sheets (e.g., 1000 sheets). If 1000 sheets have yet to be reached, it is judged that there is little change in the temperature of the exposure unit and that the change in the image misregistration amount is small, and the processing proceeds to S206 without the measured registration adjustment amount being calculated. Thus, the LD drive portion 705 drives the exposure unit 13 and performs image formation, based on the previous adjustment amount calculated at S206 and S207, without the value stored in the registration adjustment amount storage portions 714 and 715 being updated.

If it is determined in S301 that 1000 sheets or more have been printed after the registration adjustment amount (measured value) was last calculated, the CPU 700, in S302, performs formation/reading of patches of the different colors similarly to at the time of startup, and calculates the measured registration adjustment amount. Next, the processing proceeds to S303, and the CPU 700 stores the measured registration adjustment amount that was calculated in the measured registration adjustment amount (measured value) storage portion 714. Here, the registration adjustment amount stored at S104 will be overwritten with the newly calculated registration adjustment amount. Furthermore, in S304, the CPU 700 stores an output TB of the exposure unit temperature detection sensor 711 detected when patch detection was executed in the exposure unit temperature storage portion 713.

Next, in S305, the CPU 700 clears the predicted registration adjustment amount (prediction control) storage portion 715. As a result, the data of the measured registration adjustment amount (measured value) storage portion 714 newly updated at S206 will serve as the registration adjustment amount.

As described above, the image forming apparatus according to the present embodiment implements processing for calculating the measured registration adjustment amount using patches once during startup of the image forming apparatus, and implements processing for calculating the predicted registration adjustment amount in a situation where a (rapid) temperature change with a predetermined gradient or more is expected. Also, in a situation where a temperature change with a predetermined gradient or more is not expected, the processing for calculating the measured registration adjustment amount is implemented when a predetermined condition (judgment criterion), such as printing of 1000 sheets, for example, is satisfied. The image forming apparatus according to the present embodiment thereby implements registration adjustment by prediction at the time of startup, without frequently executing registration adjustment using patches that depends on a temperature change with a predetermined gradient or more. On the other hand, after the temperature change with the predetermined gradient or more has disappeared, registration adjustment using patches, which has a high adjustment accuracy, is implemented every predetermined interval. A deterioration in image quality due to registration adjustment not being performed and a reduction in convenience due to registration adjustment using patches being frequently performed immediately after startup can thereby be prevented.

Note that, in the present embodiment, the interval (judgment criterion) for executing the processing for calculating the measured registration adjustment amount (measured value) is given as 1000 printed sheets or more. However, the present invention is not limited thereto, and the number of sheets to be applied may be changed as appropriate in accordance with the image forming apparatus, or a predetermined time interval may be applied as the judgment criterion rather than the number of printed sheets.

Second Embodiment

Figure 9:
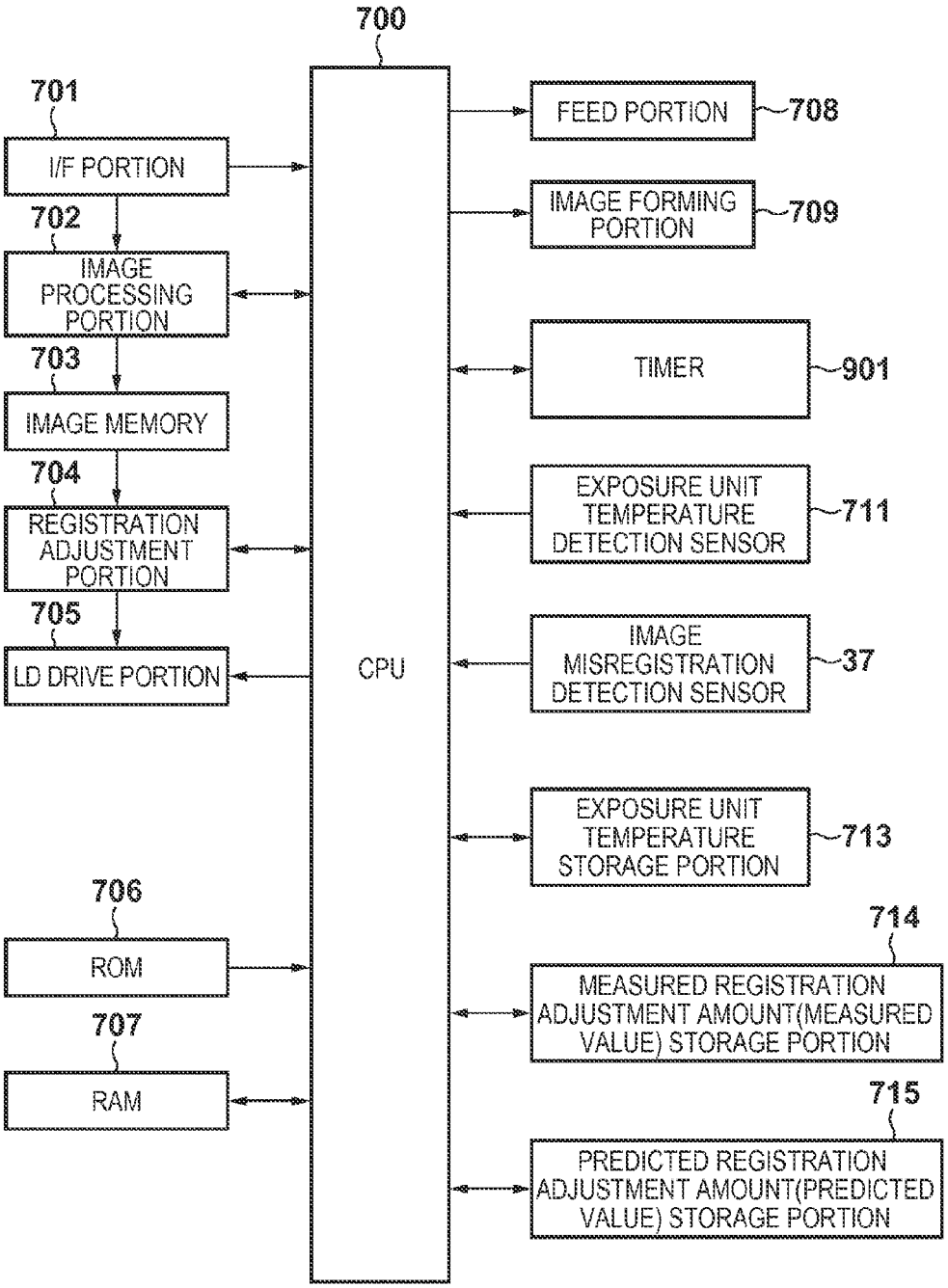
FIG. 9 is a block diagram of an image forming apparatus according to a second embodiment.
Figure 10A:
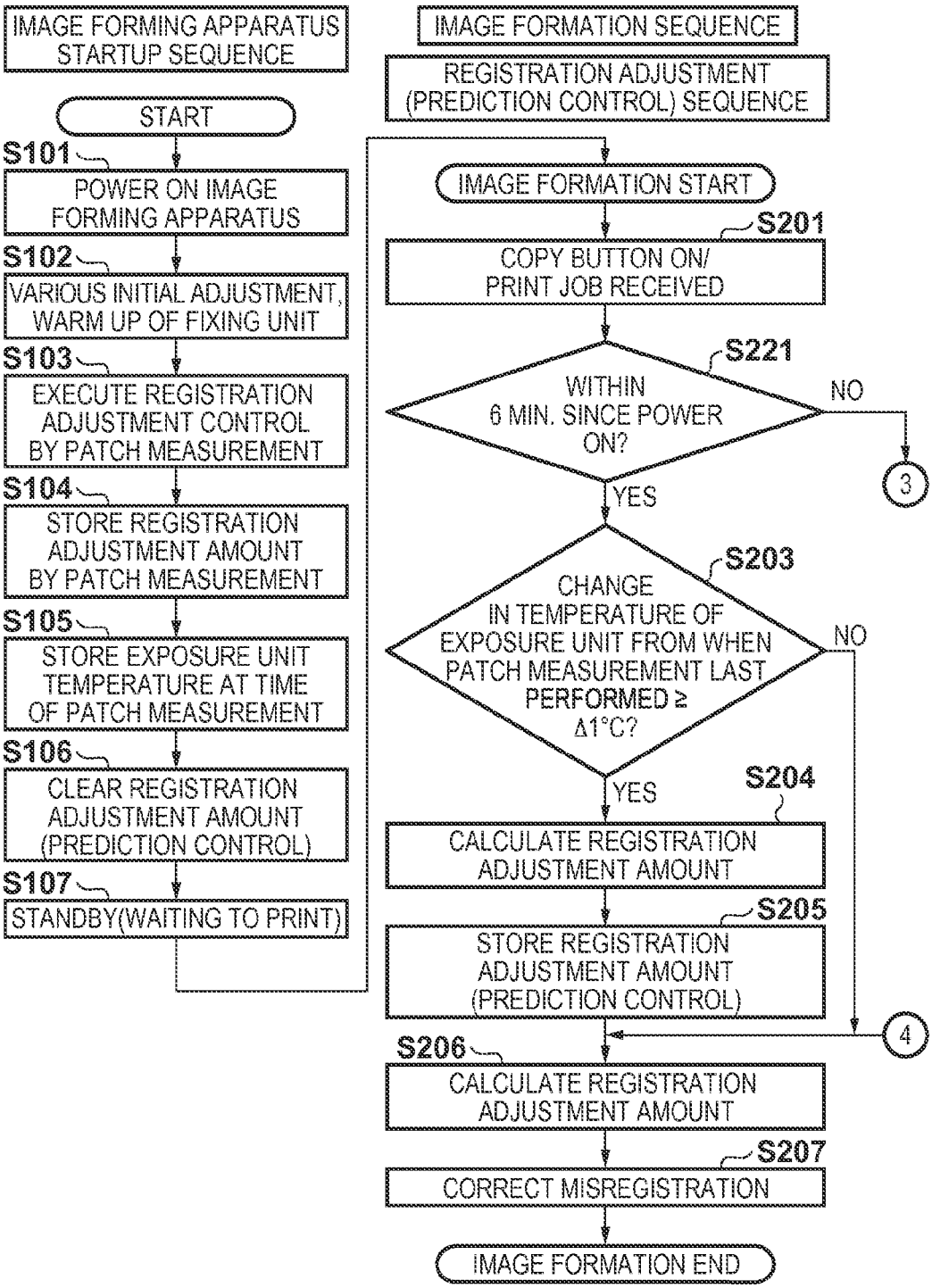
FIGS. 10A and 10B are flowcharts showing processing procedures of the image forming apparatus according to the second embodiment.
Figure 10B:
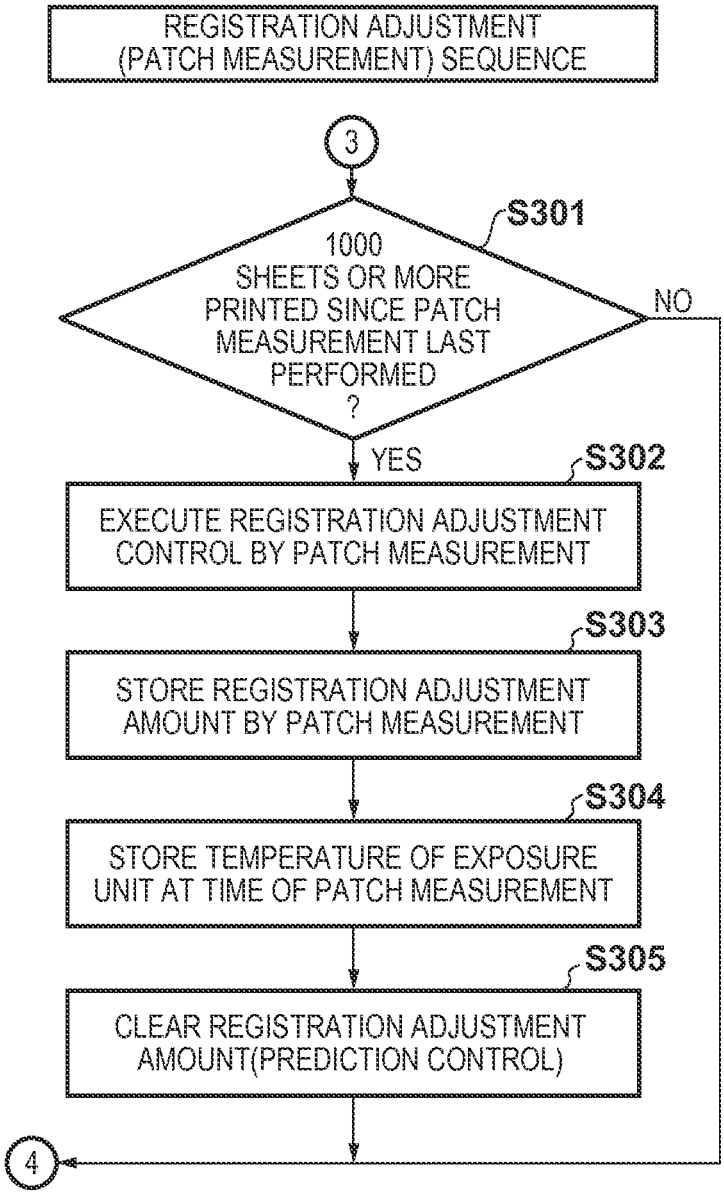

Hereinafter, a second embodiment of the present invention will be described, with reference to FIGS. 9 and 10. FIG. 9 shows a block diagram relating to image registration adjustment according to the present embodiment. FIGS. 10A and 10B show a processing procedure relating to image registration adjustment according to the present embodiment. Hereinafter, only configurations and technologies that differ from the above first embodiment will be described.

As shown in FIG. 9, the image forming apparatus is provided with a timer 901. The timer 901 is for timing elapsed time from the startup time of the image forming apparatus.

In the above first embodiment, the determination of whether to implement the processing for calculating the predicted registration adjustment amount (S203-S205) that is implemented in the case where the exposure unit 13 has a steep temperature gradient was performed in the case where the difference from room temperature detected by the environmental temperature detection sensor 710 was less than or equal to 10 degrees. However, in the present embodiment, elapsed time from when the image forming apparatus is powered on as measured by the timer 901 is the judgment criterion of the determination at S202, this being the only difference from the first embodiment. Accordingly, only the processing of S221, which replaces S202, in FIGS. 10A and 10B will be described.

In S221, the CPU 700 determines whether the elapsed time from the startup time of the image forming apparatus is within 6 minutes. If the elapsed time is within 6 minutes, the processing proceeds to S203, and if the elapsed time is 6 minutes or more, the processing proceeds to S301. As shown in FIG. 4A, since the exposure unit 13 has a steep temperature gradient until the time (6-minute mark) of the chain double-dashed line, the registration adjustment (prediction control) sequence is implemented, in the case where the elapsed time from the image forming apparatus being powered on as measured by the timer 901 is within 6 minutes. This elapsed time is a value that depends on the temperature characteristics of the exposure unit 13 of the present embodiment, and is changed as appropriate in accordance with the temperature characteristics of the image forming apparatus to which the present invention is applied.

Other Embodiments

Aspects of the present invention can also be realized by a computer of a system or apparatus (or devices such as a CPU or MPU) that reads out and executes a program recorded on a memory apparatus to perform the functions of the above-described embodiment(s), and by a method, the steps of which are performed by a computer of a system or apparatus by, for example, reading out and executing a program recorded on a memory apparatus to perform the functions of the above-described embodiment(s). For this purpose, the program is provided to the computer for example via a network or from a printing medium of various types serving as the memory apparatus (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-196640 filed on Sep. 6, 2012, which is hereby incorporated by reference herein in its entirety.

What is claimed is:

1. An image forming apparatus comprising:

an exposure unit configured to expose a photosensitive member in accordance with an image signal to form an electrostatic latent image;

a developing unit configured to develop the electrostatic latent image using a toner;

a transfer unit configured to transfer a toner image developed by the developing unit to an image carrier;

a first sensor configured to measure a temperature of the exposure unit;

a determination unit configured to determine whether the temperature of the exposure unit measured by the first sensor is changing at a predetermined gradient or more;

a calculation unit configured to calculate a registration adjustment condition; and a registration adjustment unit configured to perform registration adjustment processing based on the registration adjustment condition calculated by the calculation unit, wherein the calculation unit performs calculation processing for calculating the registration adjustment condition based on a result of detecting a position of a patch formed on the image carrier, in a case where the result of the determination by the determination unit indicates that the temperature is not changing at the predetermined gradient or more, and performs prediction processing for predicting the registration adjustment condition based on the temperature of the exposure unit measured by the first sensor, without forming a patch on the image carrier, in a case where the result of the determination by the determination unit indicates that the temperature is changing at the predetermined gradient or more.

2. The image forming apparatus according to claim 1, wherein the calculation unit controls the timing at which patch formation and the calculation processing are executed based on the number of image formed sheets from when patch formation was last executed, in a case where the result of the determination by the determination unit indicates that the temperature is not changing at the predetermined gradient or more.

3. The image forming apparatus according to claim 2, wherein the adjustment unit performs the registration adjustment processing based on the registration adjustment condition calculated by the calculation processing when patch formation was last performed, in a case where the result of the determination by the determination unit indicates that the temperature is not changing at the predetermined gradient or more and the number of image formed sheets from when patch formation was last performed is fewer than a predetermined number of sheets.

4. The image forming apparatus according to claim 1, further comprising a second sensor configured to measure an environmental temperature that is a temperature of an environment in which the image forming apparatus is placed, wherein the determination unit determines that the temperature of the exposure unit is changing at the predetermined gradient or more, in a case where a difference between the environmental temperature of the image forming apparatus measured by the second sensor and the temperature of the exposure unit is not greater than or equal to a predetermined value, and determines that the temperature of the exposure unit is not changing at the predetermined gradient or more, in a case where the difference is greater than or equal to the predetermined value.

5. The image forming apparatus according to claim 1, further comprising a timer configured to time an elapsed time from when the image forming apparatus is started up, wherein the determination unit determines that the temperature of the exposure unit is changing at the predetermined gradient or more, in a case where the elapsed time timed by the timer is not greater than or equal to a predetermined value, and determines that the temperature of the exposure unit is not changing at the predetermined gradient or more, in a case where the elapsed time is greater than or equal to a predetermined value.

6. The image forming apparatus according to claim 1, wherein the prediction processing predicts the registration adjustment condition from a misregistration amount calculated based on a patch formed when patch formation was last performed and from a misregistration amount calculated based on the temperature of the exposure unit measured by the first sensor.

7. The image forming apparatus according to claim 1, wherein the prediction processing predicts the registration adjustment condition based on a current temperature of the exposure unit, in a case where the result of the determination by the determination unit indicates that the temperature of the exposure unit is changing at the predetermined gradient or more and a difference between the current temperature of the exposure unit and the temperature of the exposure unit when calculation processing of the calculation unit was last performed is greater than a predetermined value.

8. The image forming apparatus according to claim 1, wherein the registration adjustment unit performs adjustment of a magnification ratio in a main scanning direction and a write start position in the main scanning direction.

9. The image forming apparatus according to claim 1, wherein the image forming apparatus is a color tandem image forming apparatus that includes a plurality of exposure units configured, for each different color, to expose a photosensitive member in accordance with an image signal to form an electrostatic latent image, a plurality of developing units configured to develop the electrostatic latent image with a toner of each color, and a transfer unit configured to transfer the different colored toner images developed by the plurality of developing units to a printing medium in a superimposed manner.

* * * * *